US011282531B2

(12) United States Patent
Jain et al.

(10) Patent No.: US 11,282,531 B2
(45) Date of Patent: Mar. 22, 2022

(54) TWO-DIMENSIONAL SMOOTHING OF POST-FILTER MASKS

(71) Applicant: Bose Corporation, Framingham, MA (US)

(72) Inventors: Ankita D. Jain, Westborough, MA (US); Cristian Marius Hera, Lancaster, MA (US); Elie Bou Daher, Marlborough, MA (US)

(73) Assignee: Bose Corporation, Framingham, MA (US)

( * ) Notice: Subject to any disclaimer, the term of this patent is extended or adjusted under 35 U.S.C. 154(b) by 35 days.

(21) Appl. No.: 16/779,946

(22) Filed: Feb. 3, 2020

(65) Prior Publication Data

US 2021/0241783 A1 Aug. 5, 2021

(51) Int. Cl.

| | |
|---|---|
| ***G10L 21/0232*** | (2013.01) |
| ***G10L 21/0224*** | (2013.01) |
| ***G10L 21/0272*** | (2013.01) |
| *G10L 21/0216* | (2013.01) |
| *H04R 3/00* | (2006.01) |

(52) U.S. Cl.

CPC ..... *G10L 21/0232* (2013.01); *G10L 21/0224* (2013.01); *G10L 21/0272* (2013.01); *G10L 2021/02168* (2013.01); *H04R 3/005* (2013.01)

(58) Field of Classification Search

CPC ..... G10L 21/0232; G10L 21/0224; G10L 21/0272; G10L 2021/02168; H04R 3/005

See application file for complete search history.

(56) References Cited

U.S. PATENT DOCUMENTS

2005/0186933 A1* 8/2005 Trans ..... H04L 25/085 455/296
2010/0202631 A1* 8/2010 Short ..... H03G 3/32 381/104
2010/0226448 A1* 9/2010 Dent ..... H04L 27/2647 375/260
2011/0033059 A1* 2/2011 Bhaskar ..... H04M 9/082 381/71.4
2011/0125490 A1* 5/2011 Furuta ..... G10L 21/0232 704/205
2013/0297306 A1* 11/2013 Hetherington ..... G10L 21/02 704/233
2014/0376742 A1* 12/2014 Hetherington ..... H04R 29/004 381/94.2
2015/0215700 A1* 7/2015 Sun ..... H04R 3/002 381/94.2
2015/0255083 A1* 9/2015 Krini ..... G10L 13/00 704/226

(Continued)

OTHER PUBLICATIONS

U.S. Appl. No. 16/691,114, Unknown, filed Nov. 21, 2019.
U.S. Appl. No. 16/691,196, Unknown, filed Nov. 21, 2019.

*Primary Examiner* — Michael N Opsasnick
(74) *Attorney, Agent, or Firm* — Fish & Richardson P.C.

(57) ABSTRACT

A method includes receiving multiple samples of time-domain data that includes noise, computing a first two-dimensional (2D) time-frequency representation of the time domain data, and processing the first time-frequency representation using a time-frequency noise reduction mask to generate a second, noise-reduced time-frequency representation of the time domain data. The method also includes generating a time domain output based on the noise-reduced time-frequency representation.

17 Claims, 5 Drawing Sheets

(56) References Cited

U.S. PATENT DOCUMENTS

| | | | | |
|---|---|---|---|---|
| 2015/0279388 | A1* | 10/2015 | Taenzer | G10L 15/20 704/226 |
| 2016/0150317 | A1* | 5/2016 | Hetherington | H04R 29/004 381/57 |
| 2016/0180864 | A1* | 6/2016 | Taenzer | G10L 21/034 704/226 |
| 2016/0337105 | A1* | 11/2016 | Lawton | H04L 1/0026 |
| 2017/0337934 | A1* | 11/2017 | Taenzer | G10L 15/20 |
| 2019/0206420 | A1* | 7/2019 | Kandade Rajan | G10L 15/20 |

* cited by examiner

TWO-DIMENSIONAL SMOOTHING OF POST-FILTER MASKS

TECHNICAL FIELD

This disclosure generally relates to post-filtering processes, e.g., to overcome the effect of noise on speech enhancement systems disposed in vehicles.

BACKGROUND

The perceived quality of music or speech in a moving vehicle may be degraded by variable acoustic noise present in the vehicle. This noise may result from, and be dependent upon, vehicle speed, road condition, weather, and condition of the vehicle. The presence of noise may hide soft sounds of interest and lessen the fidelity of music or the intelligibility of speech. Some audio systems can include one or more microphones intended to pick up a user's voice for certain applications, such as the near end of a telephone call or for commands to a virtual personal assistant. The acoustic signals produced by the audio system also contribute to the microphone signals, and may undesirably interfere with processing the user's voice signal.

SUMMARY

In one aspect, this document features a method that includes receiving multiple samples of time-domain data that includes noise, computing a first two-dimensional (2D) time-frequency representation of the time domain data, and processing the first time-frequency representation using a time-frequency noise reduction mask to generate a second, noise-reduced time-frequency representation of the time domain data. Generating the time-frequency noise reduction mask for a particular time-frequency bin can include determining an initial value of the mask as a function of a ratio of (i) an estimated power spectral density of the noise corresponding to the particular time-frequency bin, and (ii) an estimated power spectral density of a measured signal corresponding to the particular time-frequency bin, and updating the initial value of the mask to generate an updated value of the mask, wherein the updating is performed based on initial or updated values of one or more additional masks corresponding to time-frequency bins different from the particular time-frequency bin. The method also includes generating a time domain output based on the noise-reduced time-frequency representation.

In another aspect, this document features a system that includes a noise analysis engine and a reconstruction engine. The noise analysis engine includes one or more processing devices, and is configured to receive multiple samples of time-domain data that includes noise, compute a first two-dimensional (2D) time-frequency representation of the time domain data, and process the first time-frequency representation using a time-frequency noise reduction mask to generate a second, noise-reduced time-frequency representation of the time domain data. Generating the time-frequency noise reduction mask for a particular time-frequency bin can include determining an initial value of the mask as a function of a ratio of (i) an estimated power spectral density of the noise corresponding to the particular time-frequency bin, and (ii) an estimated power spectral density of a measured signal corresponding to the particular time-frequency bin, and updating the initial value of the mask to generate an updated value of the mask. The updating can be performed based on initial or updated values of one or more additional masks corresponding to time-frequency bins different from the particular time-frequency bin. The reconstruction engine can generate a time domain output based on the noise-reduced time-frequency representation.

In another aspect, this document features one or more non-transitory machine-readable storage devices storing machine-readable instructions that cause one or more processing devices to execute various operations. The operations include receiving multiple samples of time-domain data that includes noise, computing a first two-dimensional (2D) time-frequency representation of the time domain data, and processing the first time-frequency representation using a time-frequency noise reduction mask to generate a second, noise-reduced time-frequency representation of the time domain data. Generating the time-frequency noise reduction mask for a particular time-frequency bin can include determining an initial value of the mask as a function of a ratio of (i) an estimated power spectral density of the noise corresponding to the particular time-frequency bin, and (ii) an estimated power spectral density of a measured signal corresponding to the particular time-frequency bin, and updating the initial value of the mask to generate an updated value of the mask, wherein the updating is performed based on initial or updated values of one or more additional masks corresponding to time-frequency bins different from the particular time-frequency bin. The operations also include generating a time domain output based on the noise-reduced time-frequency representation.

Implementations of the above aspects can include one or more of the following features.

Updating the initial value of the mask can include determining a time-smoothing parameter for updating the initial value as a function of the initial or updated values of one or more additional masks corresponding to time-frequency bins along the time axis of the 2D time-frequency representation. The time smoothing parameter can be a function of the initial or updated values of multiple masks corresponding to different time points. The updated value of the mask can be generated as a function of the time-smoothing parameter. Updating the initial value of the mask can include determining a frequency-smoothing parameter for updating the initial value as a function of the initial or updated values of one or more additional masks corresponding to time-frequency bins along the frequency axis of the 2D time-frequency representation. The frequency smoothing parameter can represent a variable number of time-frequency bins along the frequency axis that are used in updating the initial value. The updated value of the mask can be generated as a function of the frequency-smoothing parameter. User-input on an upper limit of a frequency range for frequency smoothing can be received, and the number of time-frequency bins along the frequency axis that are used in updating the initial value can be determined as a function of the upper limit of a frequency range. Updating the initial value of the mask can include determining a time-smoothing parameter for updating the initial value as a function of the initial or updated values of one or more additional masks corresponding to time-frequency bins along the time axis of the 2D time-frequency representation, determining a frequency-smoothing parameter for updating the initial value as a function of the initial or updated values of one or more additional masks corresponding to time-frequency bins along the frequency axis of the 2D time-frequency representation, and generating the updated value of the mask as a function of the time-smoothing parameter and the frequency-smoothing parameter. The time smoothing parameter can be a function of the initial or updated values of multiple masks corresponding to different time points, and the frequency smoothing parameter can represent a variable number of time-frequency bins along the frequency axis that are used in updating the initial value. User-input on an upper limit of a frequency range for frequency smoothing can be received, and the number of time-frequency bins along the frequency axis that are used in updating the initial value can be determined as a function of the upper limit of a frequency range.

In some implementations, the technology described herein may provide one or more of the following advantages.

In some implementations, a post-filter mask can be adaptively smoothed simultaneously over time and frequency to improve noise reduction and/or echo cancellation performance. By adaptively adjusting one or more parameters of the 2D smoothing process based on characteristics of the input signal, the process can be configured to generate noise estimates that reduce distortions in the reconstructed speech, and/or improve the performance of the corresponding noise reduction/suppression or post-filtering systems.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

Figure 1:
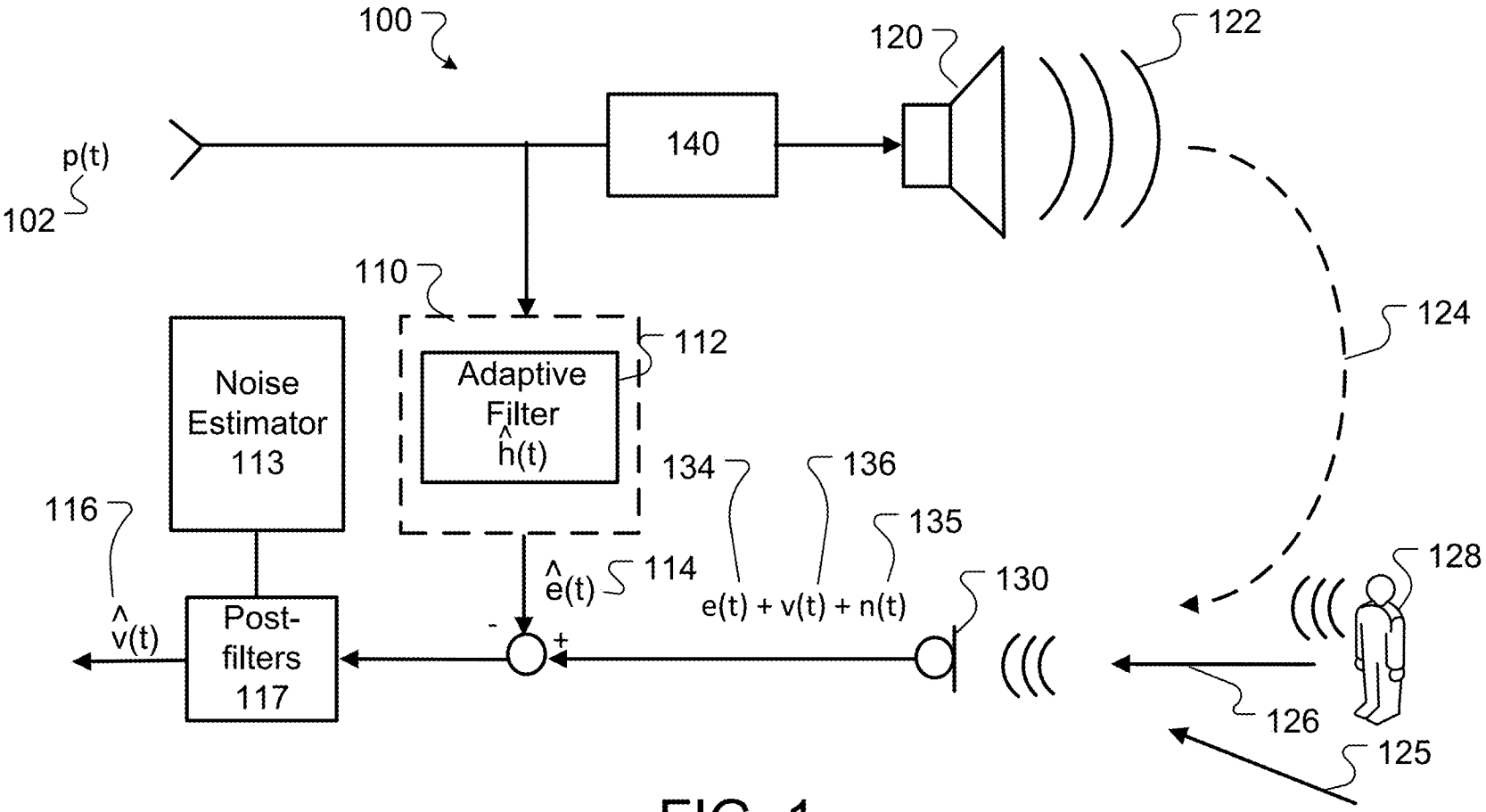
FIG. 1 is a block diagram of an example audio processing system disposed in a vehicle.

The technology described in this document is generally directed to adaptive time-frequency masks for noise suppression/reduction (NR) or other post-filtering (PF) processes used in, for example, reducing speech artifacts and/or improving speech intelligibility. The adaptive masks can be implemented, for example, by averaging along both time and frequency axes of a time-frequency representation of the mask, where parameters of the averaging process (e.g., length of the window along the frequency axis, and/or weights along the time axis) can be determined adaptively in a data-driven approach. In some cases, such adaptive two-dimensional (2D) averaging of PF/NR masks can improve performance (e.g., by reducing speech distortion that presents itself in the form of "afterglow" or long trailing end of "smeared" speech and tonal shift towards higher frequencies) as compared to processes in which averaging is performed along one dimension (e.g., in either time domain only, frequency domain only, or one followed by the other in a sequential manner).

Audio systems, especially automotive audio systems, may produce acoustic signals in an environment, e.g., a vehicle compartment, for entertainment, information, communication, and navigation, for example. The quality of music or speech in such environments may be degraded, for example, by variable acoustic noise present in the vehicle. This noise may result from, and be dependent upon, vehicle speed, road condition, weather, and condition of the vehicle. Such audio systems may also accept acoustic input from the occupants, e.g., via one or more microphones, for various purposes such as telephone conversations, verbal commands to a navigation system or a virtual personal assistant. Noise reduction and/or echo cancellation/suppression systems can be employed to improve the perception of the reproduced audio and/or the intelligibility of speech for speech recognition purposes.

When the audio system renders an acoustic signal, e.g., via a loudspeaker, the microphone(s) may also pick up the rendered acoustic signal in addition to the user's voice. For example, the user may be having a phone conversation and listening to the radio at the same time, and the microphone will pick up both the user's voice and the radio program. A portion of the microphone signal may therefore be due to the audio system's own acoustic production, and that portion of the microphone signal is deemed an echo signal. In such cases, an acoustic echo canceler may be used to reduce or remove the echo signal portion from the microphone signal. When multiple loudspeakers and/or multiple audio signal sources are used, there may be multiple acoustic echo cancelers involved. After the action of one or more echo cancelers, a portion of the echo signal may remain, and is deemed a residual echo. Aspects and examples disclosed herein suppress the residual echo by applying a post filter ("post" refers to the filter's action occurring after the echo canceler). The post filter applies spectral enhancement to reduce (suppress) spectral content that is likely due to residual echo and not a user's vocalizations, thereby enhancing the speech content in the signal relative to the non-speech content.

In some implementations, a post filter can also be used for noise reduction, wherein the post filter can be configured to adapt to changes in the amount of noise in the environment. For example, a vehicular audio system can be configured to estimate an amount of noise in the environment, and a post filter can be adjusted based on one or more parameters of the noise estimate. Such a noise reduction post filter can be used with or without an echo canceler post filter.

A post filter (regardless of whether it is a noise reduction post filter or an echo canceler post filter) can be configured to operate on, for example, a microphone signal having a desired user voice component and undesired residual echo and noise components. The microphone signal could be an arrayed combination of signals from a plurality of microphones. A post filter may be implemented as a mask, e.g., as a set of multiplier values between zero and one, for each of multiple time-frequency bins. The multiplier values can be adaptively changed over time, for example, to account for changing noise levels and/or echo. To reduce drastic changes in the mask in either of the frequency dimension or the time dimension, the technology described in this document espouses a 2D time-frequency smoothing of the post-filter mask.

FIG. 1 is a block diagram of an example audio processing system disposed in a vehicle. FIG. 1 illustrates an example audio system 100 that includes an echo canceler 110, one or more acoustic drivers 120, and one or more microphones 130. The audio system 100 receives a program content signal 102, p(t), which is converted into an acoustic program signal 122 by the one or more acoustic drivers 120. The acoustic drivers 120 may have further processing component(s) 140 associated with them, such as may provide array processing, amplification, equalization, mixing, etc. Additionally, the program content signal 102 may include multiple tracks, such as a stereo left and right pair, or multiple program content signals to be mixed or processed in various ways. The program content signal 102 may be an analog or digital signal and may be provided as a compressed and/or packetized stream, and additional information may be received as part of such a stream, such as instructions, commands, or parameters from another system for control and/or configuration of the processing component(s) 140, the echo canceler 110, or other components.

The block diagrams illustrated in the figures, such as the example audio system 100 of FIG. 1, are schematic representations and not necessarily illustrative of individual hardware elements. For instance, in some examples, each of the echo canceler(s) 110, the processing component(s) 140, and other components and/or any portions or combinations of these, may be implemented in one set of circuitry, such as a digital signal processor, a controller, or other logic circuitry, and may include instructions for the circuitry to perform the functions described herein.

A microphone, such as the microphone 130, may receive each of an acoustic echo signal 124, an acoustic voice signal 126 from a user 128, and other acoustic signals such as background noise and/or road noise 125. The microphone 130 converts acoustic signals into, e.g., electrical signals, and provides them to the echo canceler 110. Specifically, when a user 128 is speaking, the microphone 130 provides a voice signal 136, v(t), and an echo signal 134, e(t), and noise signal n(t), as part of a combined signal to the echo canceler 110. In the absence of the echo signal v(t), a noise estimator 113 functions to attempt to remove the noise signal 135 from the combined signal to provide an estimated voice signal 116. For example, for a noise reduction process, a noise signal n(t) can be picked up by the microphone 130, and the noise estimator 113 can be configured to generate a noise estimate n(t), which then may be removed from the signal picked up by the microphone 130. In the absence of the noise signal n(t), the echo canceler 110 functions to attempt to remove the echo signal 134 from the combined signal to provide an estimated voice signal 116. The echo canceler 110 works to remove the echo signal 134 by processing the program content signal 102 through a filter 112 to produce an estimated echo signal 114, e(t), which is subtracted from the signal provided by the microphone 130. In some implementations, when both a noise signal and an echo signal are present in the combined signal, the system 100 can include both an echo canceler 110 and a noise estimator 113 functioning in conjunction with one another.

The echo canceler 110 may implement an adaptive process to update the adaptive filter 112, at intervals, to improve the estimated echo signal 114. Over time, the adaptive algorithm causes the filter 112 to converge on satisfactory parameters that produce a sufficiently accurate estimated echo signal 114. Generally, the adaptive algorithm updates the filter during times when the user 128 is not speaking, but in some examples the adaptive algorithm may make updates at any time. When the user 128 speaks, such is deemed "double talk," and the microphone 130 picks up both the acoustic echo signal 124 and the acoustic voice signal 126. Regarding the terminology, the user 128 is "talking" at the same time as one or more acoustic drivers 120 are producing acoustic program content, or "talking," hence, "double talk."

The filter 112 may apply a set of filter coefficients to the program content signal 102 to produce the estimated echo signal 114, $\hat{e}(t)$. The adaptive algorithm may use any of various techniques to determine the filter coefficients and to update, or change, the filter coefficients to improve performance of the filter 112. In some examples, the adaptive algorithm may operate on a background filter, separate from the filter 112, to seek out a set of filter coefficients that performs better than an active set of coefficients being used in the filter 112. When a better set of coefficients is identified, they may be copied to the filter 112 in active operation.

In some implementations, an adaptive filter of the noise estimator 113 can be configured to generate an estimate of noise of the environment. This can be done, for example, in conjunction with the echo canceler 110, or using an independent system where an echo canceler is not present. The noise estimate can be generated using any adaptive process. In some implementations, in order to reduce sudden variations in the generated estimates, a time-smoothing and/or frequency smoothing process can be used in the corresponding adaptive filter of the noise estimator 113. Examples of such time smoothing and frequency smoothing are described in U.S. application Ser. No. 16/691,114, and U.S. application Ser. No. 16/691,196, both filed on Nov. 21, 2019, the contents of which are incorporated herein by reference.

Adaptive processes that may be used in the adaptive filters, whether in a noise estimator 113 or an echo canceler 110, may include, for example, a least mean squares (LMS) algorithm, a normalized least mean squares (NLMS) algorithm, a recursive least square (RLS) algorithm, or any combination or variation of these or other algorithms. The adaptive filter, as adapted by the adaptive process, converges to apply an estimated transfer function 118, $\hat{h}(t)$, which is representative of the overall response of the processing 140, the acoustic driver(s) 120, the acoustic environment, and the microphone(s) 130, to the program content signal 102. The transfer function is a representation of how the program content signal 102 is transformed from its received form into the echo signal 134 (or noise estimate).

While the echo canceler 110 works to remove the echo signal 134 from the combined microphone signal, rapid changes and/or non-linearities in the echo path prevent the echo canceler 110 from providing a precise estimated echo signal 114 to perfectly match the echo signal 134, and a residual echo will remain at the output. According to aspects and examples enclosed herein, the residual echo is reduced, or suppressed, by the addition of one or more post filters 117 to spectrally enhance the estimated voice signal 116. The one or more post-filters 117 can also include a post-filter to remove noise from the microphone signal based on an estimate of the noise provided by the noise estimator 113.

Figure 2A:
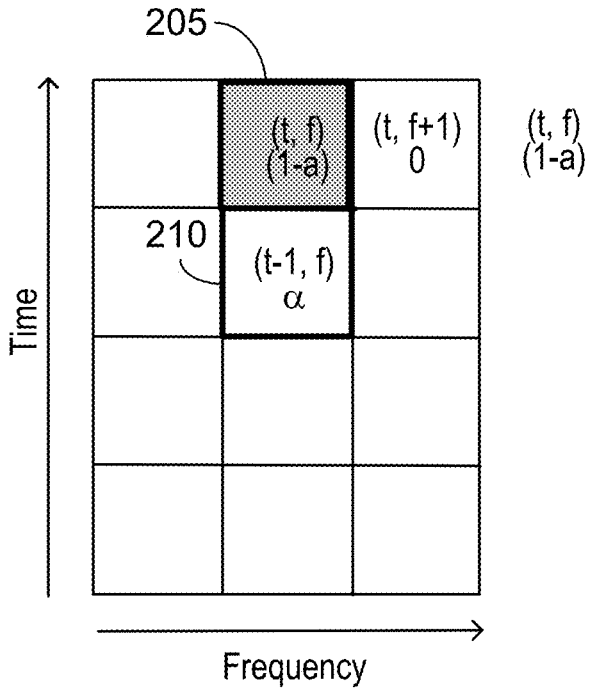
FIGS. 2A-2C are representations of time-frequency bins illustrating various one dimensional smoothing schemes for post-filters described herein.
Figure 2B:
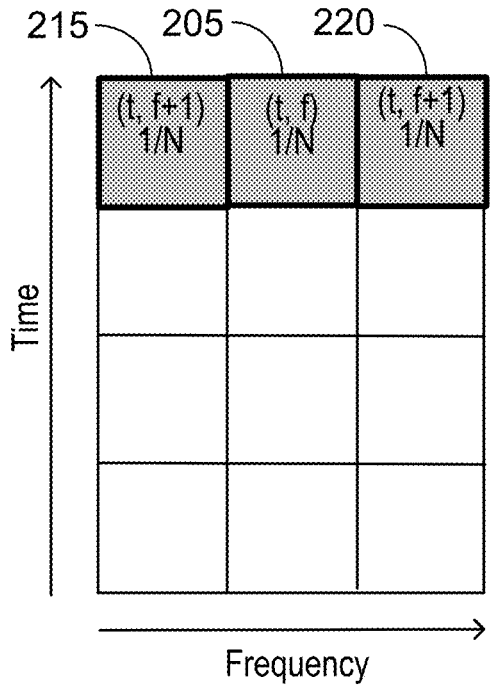
Figure 2C:
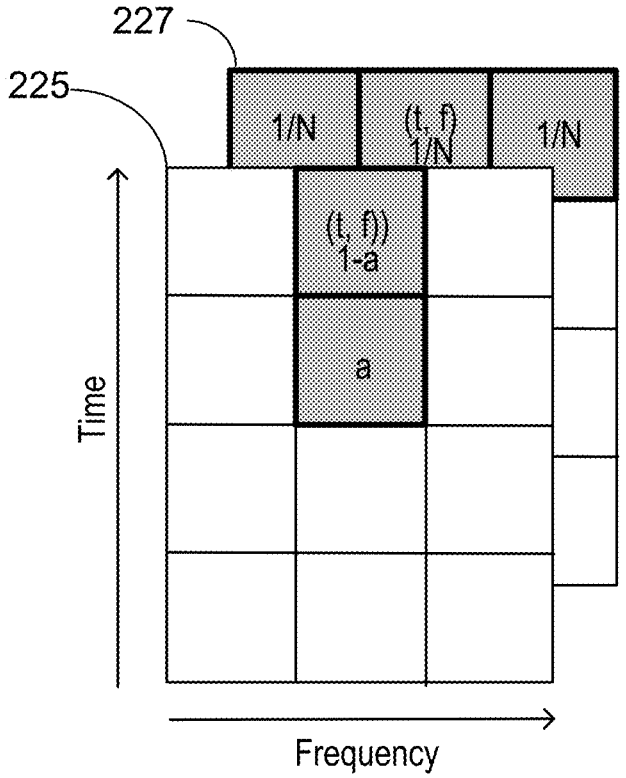

A post filter 117 can be implemented, for example, as an adaptive mask, that can be adjusted, for example, to account for varying noise (when used as a noise reduction post filter) or varying amount of residual echo (when used as an echo cancellation post-filter). An averaging process can be implemented in determining the mask values such that the values do not vary significantly from one instance of the mask to the next. In some implementations, the averaging process can be done in a single dimension only, e.g. along a time dimension or a frequency dimension, or both along time and frequency dimensions, but one after the other. These situations are illustrated in FIGS. 2A-2C, which graphically illustrate averaging along the time dimension (e.g., over the bins 205 and 210 in the time-frequency representation of FIG. 2A), averaging along the frequency dimension (e.g., over the bins 215, 205 and 220 in the time-frequency representation of FIG. 2B), and averaging over time followed by averaging over frequency (as illustrated using the time-frequency representations 225 and 227), respectively.

In some implementations, the 2D time-frequency filtering described herein improves potential undesirable effects of one dimensional averaging processes (e.g., the afterglow effect described above) without degrading the noise reduction or post-filtering performances to unacceptable levels. In some cases, the 2D filters described herein retains the structure of speech during transitions that aren't captured by voice activity detector or double talk detector, and therefore reduces artifacts. The 2D filters may also improve the tonal balance of speech by avoiding averaging (or at least reducing the number of frequency bins over which frequency averaging is performed) in the presence of speech. In addition, the 2D filters retain the desirable properties of the single-dimensional time and frequency filters by reducing peaks in the noise (by averaging over adjacent bins over time) and reducing musical noise by averaging over multiple frequency bins, respectively.

In some implementations, the time-frequency mask, denoted herein as Hnr(t,f), can be computed using the estimated PSDs of noise $\widehat{S_{nn}(t,f)}$, and total measured signal $S_{tt}(t,f)$.

$$Hnr(t, f) = 1 - \frac{\widehat{S_{nn}(t,f)}}{S_{tt}(t, f)} = \frac{\widehat{S_{ss}(t,f)}}{S_{tt}(t, f)} \tag{1}$$

where the noise and speech are uncorrelated, and $\widehat{S_{ss}(t,f)}$ denotes the estimated PSD of speech. This representation of the time-frequency mask can be adjusted to represent the single dimensional time and frequency averaging described above. For example, the single-dimensional time averaging of FIG. 2A can be represented using a time-frequency mask approach as:

$$Hnr_{smoothed}(t,f)=(1-\alpha)Hnr_{unsmoothed}(t,f)+\alpha Hnr_{smoothed}(t-1,f) \tag{2}$$

where $\alpha$ is the weight of the previous time bin and correspondingly $1-\alpha$ is the weight of the current time bin for each frequency bin. This mask is therefore parameterized by a single parameter $\alpha$. Similarly, the single dimensional frequency averaging of FIG. 2B can be represented as a time-frequency mask as:

$$Hnr_{smoothed}(t, f) = \frac{1}{N} \sum_{k=-\frac{(N-1)}{2}}^{\frac{(N-1)}{2}} Hnr_{unsmoothed}(t, f-k) \tag{3}$$

where N is the number of frequency bins over which the averaging is performed. Equation (3) assumes equal weight to all frequency bins, and the averaging is centered at the current time-frequency bin. The mask can be adjusted for other shapes and types of windows.

In some implementations, the 2D time-frequency mask used in the post-filter is given as:

$$Hnr_{smoothed}(t, f) = \frac{1-\alpha}{N} \sum_{k=-\frac{(N-1)}{2}}^{\frac{(N-1)}{2}} Hnr_{unsmoothed}(t, f-k) + \tag{4}$$

Figure 3A:
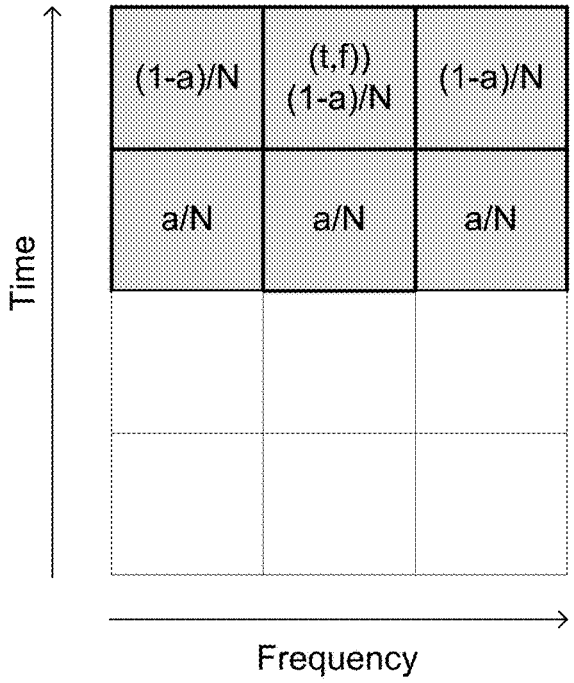
FIGS. 3A-3C are representations of time-frequency bins illustrating various two-dimensional (2D) smoothing schemes described herein.

-continued $$\frac{\alpha}{N} \sum_{k=-\frac{(N-1)}{2}}^{\frac{(N-1)}{2}} Hnr_{smoothed}(t-1, f-k)$$

where one or more of the smoothing factor $\alpha$ and the window size N can be fixed or variable. The case for a fixed $\alpha$ and fixed N is illustrated using FIG. 3A, which shows one representation of a 2D time-frequency smoothing scheme.

If a is selected to be variable, $\alpha$ can be determined, in at least one example, by taking the average of $H_{nr}$ over the N frequency bins and two time steps—the current one and the previous one, as:

$$\alpha(t, f) = 1 - \left[ \frac{1}{N} \sum_{k=-\frac{(N-1)}{2}}^{\frac{(N-1)}{2}} Hnr_{unsmoothed}(t, f-k) + \frac{1}{N} \sum_{k=-\frac{(N-1)}{2}}^{\frac{(N-1)}{2}} Hnr_{unsmoothed}(t-1, f-k) \right] \tag{5}$$

Figure 3B:
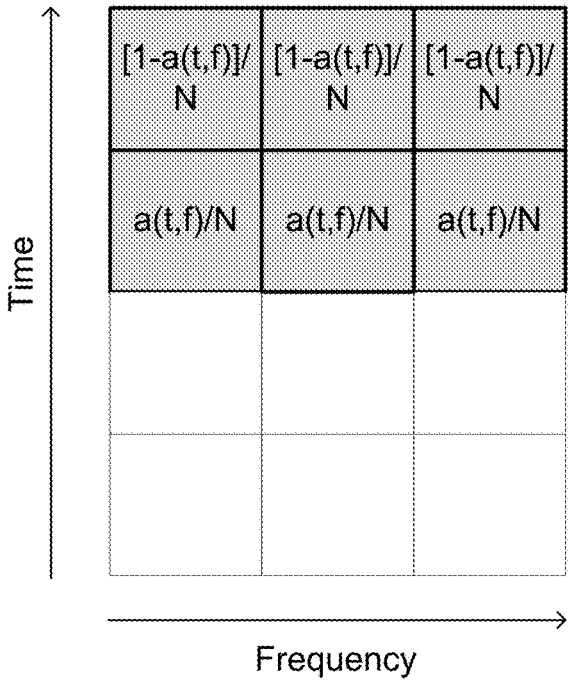

An $\alpha$ computed using equation (5) can then be used in equation (4). As per equation (5), $\alpha$ is computed as the average of the time-frequency mask over the number of frequency bins and two time steps, the current and the previous one. The use of this equation is possible because the value of the time-frequency mask $H_{nr}$ always lies between 0 and 1. Therefore, if the surrounding bins contain mostly speech, then the averaging window is effectively small. Conversely, if the surrounding bins contain mostly noise, then $\alpha(t,f)$ is large and the averaging is performed over a relatively longer time window. The time-frequency smoothing scheme for a variable $\alpha$ and fixed N is shown graphically in FIG. 3B.

In some implementations, both a and N can be variable. In such cases, $\alpha$ can be determined, for example, using equation (5), and the number of frequency bins to average over N(t,f) is determined, for example, based on a user-defined limit on maximum frequency range of averaging $F_{max}$. For example, the frequency range of averaging for the current time-frequency bin is computed as a function of $F_{max}$ as:

$$F(t,f)=(1-Hnr_{unsmoothed}(t,f))F_{max} \tag{6}$$

Figure 3C:
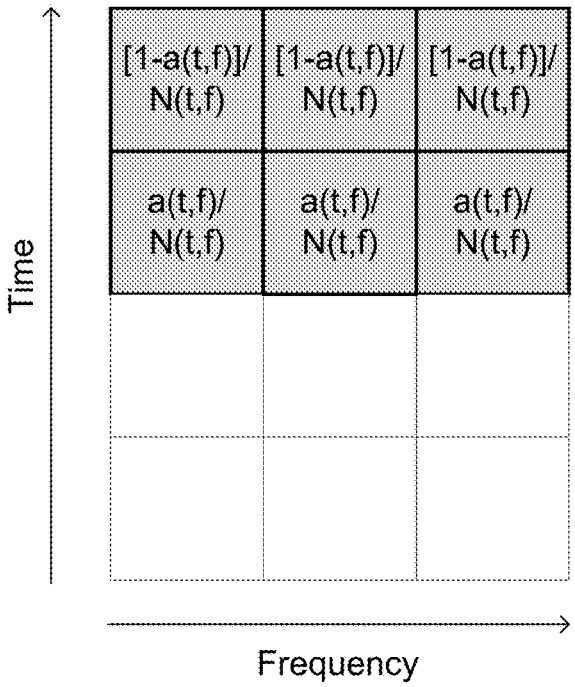

The number of bins this range corresponds to can be computed as:

$$N(t, f) = ceil\left[\frac{F(t, f)}{\frac{Fs}{nfft}}\right] \tag{7}$$

where $F_s$ is the sampling frequency and nfft is the number of FFT points in the time-frequency mask. Therefore, the higher the value of the current bin, the lower is the averaging performed. The assumption is that large values in the time-frequency mask are associated with speech for which the amount of change is limited. On the other hand, if the current bin value is zero or near-zero, maximum averaging is performed under the assumption that the bin includes only noise. An example of a 2D averaging scheme with a variable $\alpha$ (as computed using equation (5)), and a variable N (as computed using equations (6) and (7)), is represented graphically in FIG. 3C. The smoothing scheme that uses a variable N, but a fixed $\alpha$, is not shown, but is also within the scope of this disclosure.

Figure 4:
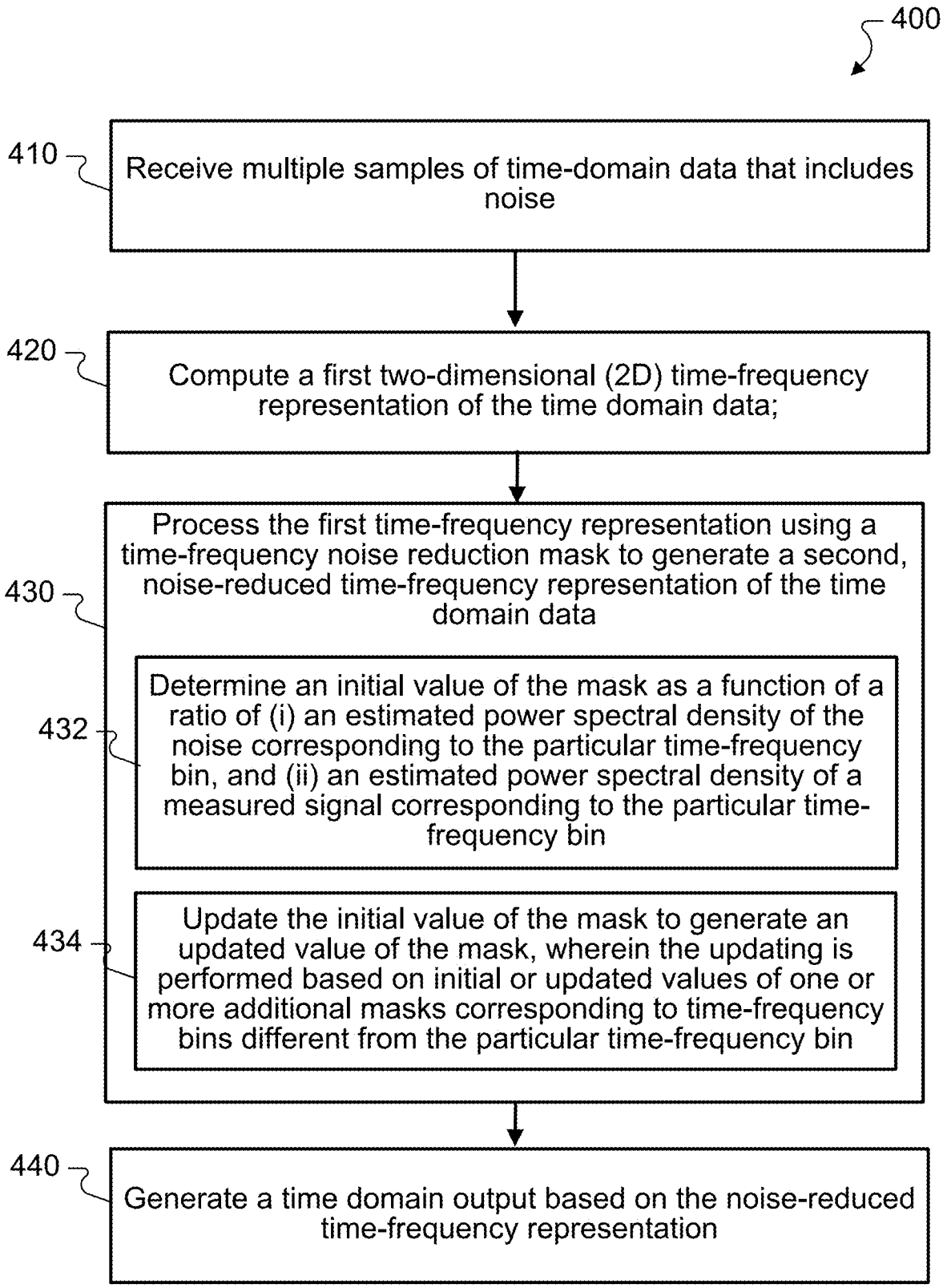
FIG. 4 is a flow chart of an example process to smooth the mask for noise reduction using a two-dimensional adaptive time-frequency smoothing scheme described herein.

FIG. 4 is a flow chart of an example process 400 for smoothening the noise reduction mask using a two-dimensional adaptive time-frequency smoothing scheme described herein. In some implementations, at least a portion of the process 400 can be performed by one or more processing devices used for implementing the post-filters 117. For example, the echo canceler 110 and/or the noise estimator 113 can include one or more processing devices that can be used to generate the mask values for the one or more post filters 117 in accordance with the description herein.

Operations of the process 400 can include receiving multiple samples of time-domain data that includes noise (410). In some implementations, the time domain data can be generated from the microphone signals 104. For example, the audio processing system 100 can include an analog to digital converter that converts analog signals generated by one or more microphones to digital samples of time domain data.

Operations of the process 400 also includes computing a first two-dimensional (2D) time-frequency representation of the time domain data (420). In some implementations, the one or more processing device associated with the echo canceler 110 and/or the noise estimator 113 can be configured to divide the incoming time domain data into multiple frames, and compute a frequency domain representation for each frame.

Operations of the process 400 can also include processing the first time-frequency representation using a time-frequency noise reduction mask to generate a second, noise-reduced time-frequency representation of the time domain data (430). Generating the time-frequency noise reduction mask for a particular time-frequency bin can include determining an initial value of the mask as a function of a ratio of (i) an estimated power spectral density of the noise corresponding to the particular time-frequency bin, and (ii) an estimated power spectral density of a measured signal corresponding to the particular time-frequency bin (432), and updating the initial value of the mask to generate an updated value of the mask (434). The updating can be performed, for example, based on initial or updated values of one or more additional masks corresponding to time-frequency bins different from the particular time-frequency bin.

In some implementations, updating the initial value of the mask can include determining a time-smoothing parameter $\alpha$ for updating the initial value as a function of the initial or updated values of one or more additional masks corresponding to time-frequency bins along the time axis of the 2D time-frequency representation. For example, the initial or current mask can be represented as $Hnr_{unsmoothed}(t, f)$, the updated time-frequency mask can be represented as $Hnr_{smoothed}(t, f)$, and the time smoothing parameter can be determined, for example, as per equation (5) described above. In such cases, the time smoothing parameter $\alpha$ can be a function of the initial or updated values of multiple masks corresponding to different time points. The updated value of the mask can be generated, for example, as a function of the time-smoothing parameter as provided by equation (2) above.

In some implementations, updating the initial value of the mask can include determining a frequency-smoothing parameter for updating the initial value as a function of the initial or updated values of one or more additional masks corresponding to time-frequency bins along the frequency axis of the 2D time-frequency representation. The frequency smoothing parameter can represent a variable number of time-frequency bins along the frequency axis that are used in updating the initial value. This can be done, for example, as per equations (6) and (7) described above, with equation (7) providing for the number of bins for a particular time-frequency bin. In some implementations, an upper limit of a frequency range for frequency smoothing is received as a user-input, and the number of time-frequency bins along the frequency axis that are used in updating the initial value is determined as a function of the upper limit of a frequency range. The updated value of the mask can then be generated as a function of the frequency-smoothing parameter.

In some implementations, both the time-smoothing parameter and the frequency smoothing parameter are determined such that the updated value of the mask is determined as a function of the time-smoothing parameter and the frequency-smoothing parameter. For example, updating the initial value of the mask can include determining a time-smoothing parameter for updating the initial value as a function of the initial or updated values of one or more additional masks corresponding to time-frequency bins along the time axis of the 2D time-frequency representation, determining a frequency-smoothing parameter for updating the initial value as a function of the initial or updated values of one or more additional masks corresponding to time-frequency bins along the frequency axis of the 2D time-frequency representation, and generating the updated value of the mask as a function of the time-smoothing parameter and the frequency-smoothing parameter. In some implementations, the time smoothing parameter can be a function of the initial or updated values of multiple masks corresponding to different time points. In some implementations, the frequency smoothing parameter represents a variable number of time-frequency bins along the frequency axis that are used in updating the initial value.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory storage medium for execution by, or to control the operation of, data processing apparatus. The computer storage medium can be a machine-readable storage device, a machine-readable storage substrate, a random or serial access memory device, or a combination of one or more of them.

Figure 5:
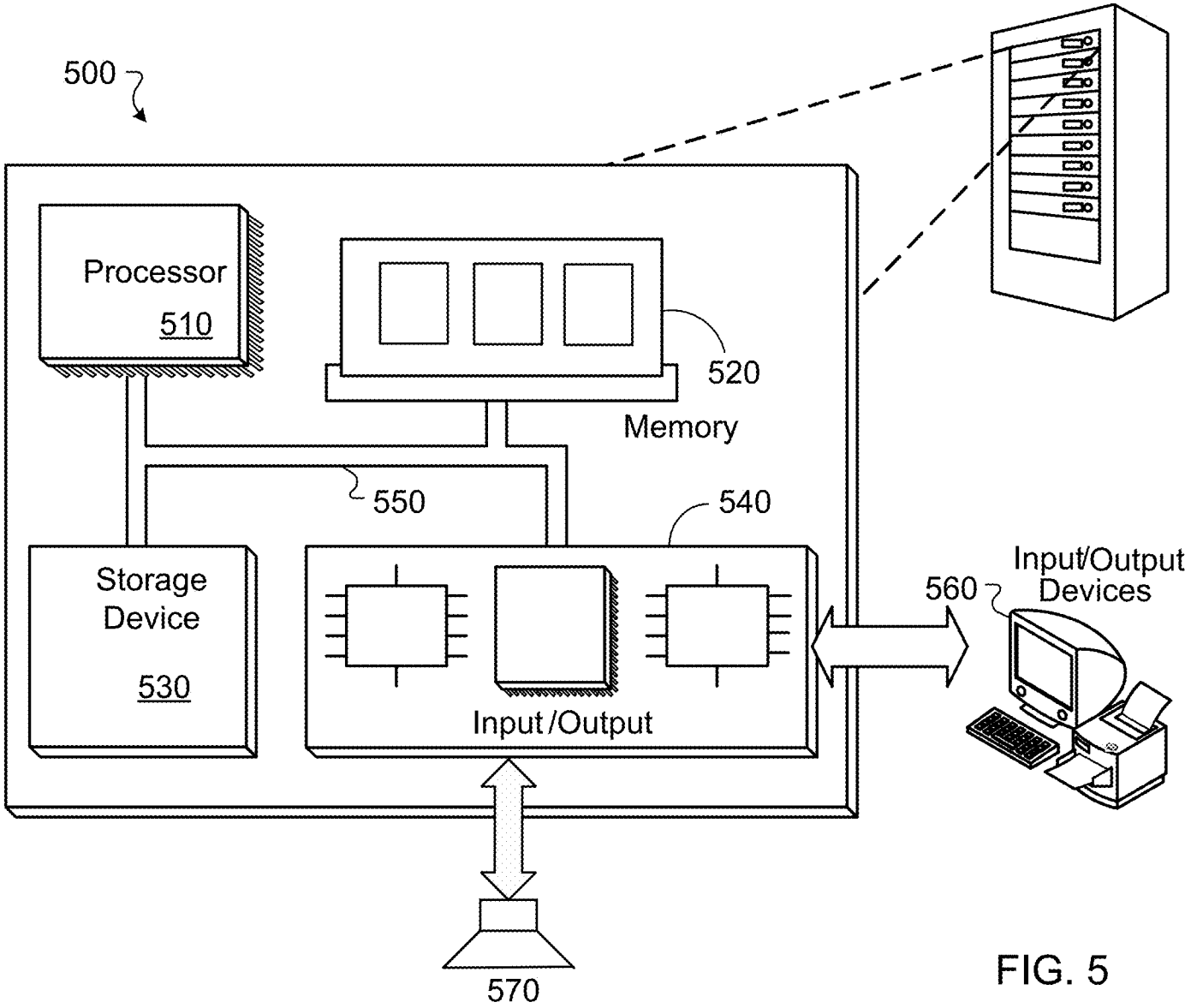
FIG. 5 is a block diagram of an example of a computing device

FIG. 5 is block diagram of an example computer system 500 that can be used to perform operations described above. For example, the adaptive filters and post-filters described in connection to FIG. 1 can be implemented using at least portions of the computer system 500. The system 500 includes a processor 510, a memory 520, a storage device 530, and an input/output device 540. Each of the components 510, 520, 530, and 540 can be interconnected, for example, using a system bus 550. The processor 510 is capable of processing instructions for execution within the system 500. In one implementation, the processor 510 is a single-threaded processor. In another implementation, the processor 510 is a multi-threaded processor. The processor 510 is capable of processing instructions stored in the memory 520 or on the storage device 530.

The memory 520 stores information within the system 500. In one implementation, the memory 520 is a computer-readable medium. In one implementation, the memory 520 is a volatile memory unit. In another implementation, the memory 520 is a non-volatile memory unit.

The storage device 530 is capable of providing mass storage for the system 500. In one implementation, the storage device 530 is a computer-readable medium. In various different implementations, the storage device 530 can include, for example, a hard disk device, an optical disk device, a storage device that is shared over a network by multiple computing devices (e.g., a cloud storage device), or some other large capacity storage device.

The input/output device 540 provides input/output operations for the system 500. In one implementation, the input/output device 540 can include one or more network interface devices, e.g., an Ethernet card, a serial communication device, e.g., and RS-232 port, and/or a wireless interface device, e.g., and 802.11 card. In another implementation, the input/output device can include driver devices configured to receive input data and send output data to other input/output devices, e.g., keyboard, printer and display devices 560, and acoustic transducers/speakers 570.

Although an example processing system has been described in FIG. 5, implementations of the subject matter and the functional operations described in this specification can be implemented in other types of digital electronic circuitry, or in computer software, firmware, or hardware, including the structures disclosed in this specification and their structural equivalents, or in combinations of one or more of them.

This specification uses the term "configured" in connection with systems and computer program components. For a system of one or more computers to be configured to perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the operations or actions.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non transitory storage medium for execution by, or to control the operation of, data processing apparatus. The computer storage medium can be a machine-readable storage device, a machine-readable storage substrate, a random or serial access memory device, or a combination of one or more of them. Alternatively or in addition, the program instructions can be encoded on an artificially generated propagated signal, e.g., a machine-generated electrical, optical, or electromagnetic signal, which is generated to encode information for transmission to suitable receiver apparatus for execution by a data processing apparatus.

The term "data processing apparatus" refers to data processing hardware and encompasses all kinds of apparatus, devices, and machines for processing data, including by way of example a programmable processor, a computer, or multiple processors or computers. The apparatus can also be, or further include, special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

A computer program, which may also be referred to or described as a program, software, a software application, an app, a module, a software module, a script, or code, can be written in any form of programming language, including compiled or interpreted languages, or declarative or procedural languages, and it can be deployed in any form, including as a stand-alone program or as a module, component, subroutine, or other unit suitable for use in a computing environment. A program may, but need not, correspond to a file in a file system. A program can be stored in a portion of a file that holds other programs or data, e.g., one or more scripts stored in a markup language document, in a single file dedicated to the program in question, or in multiple coordinated files, e.g., files that store one or more modules, sub programs, or portions of code. A computer program can be deployed to be executed on one computer or on multiple computers that are located at one site or distributed across multiple sites and interconnected by a data communication network.

The processes and logic flows described in this specification can be performed by one or more programmable computers executing one or more computer programs to perform functions by operating on input data and generating output. The processes and logic flows can also be performed by special purpose logic circuitry, e.g., an FPGA or an ASIC, or by a combination of special purpose logic circuitry and one or more programmed computers.

Embodiments of the subject matter described in this specification can be implemented in a computing system that includes a back end component, e.g., as a data server, or that includes a middleware component, e.g., an application server, or that includes a front end component, e.g., a client computer having a graphical user interface, a web browser, or an app through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network (LAN) and a wide area network (WAN), e.g., the Internet.

The computing system can include clients and servers. A client and server are generally remote from each other and typically interact through a communication network. The relationship of client and server arises by virtue of computer programs running on the respective computers and having a client-server relationship to each other. In some embodiments, a server transmits data, e.g., an HTML page, to a user device, e.g., for purposes of displaying data to and receiving user input from a user interacting with the device, which acts as a client. Data generated at the user device, e.g., a result of the user interaction, can be received at the server from the device.

Other embodiments and applications not specifically described herein are also within the scope of the following claims. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

While this specification contains many specific implementation details, these should not be construed as limitations on the scope of any claims or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

What is claimed is:

1. A method comprising:

receiving multiple samples of time-domain data that includes noise;

computing a first two-dimensional (2D) time-frequency representation of the time domain data;

processing the first time-frequency representation using a time-frequency noise reduction mask to generate a second, noise-reduced time-frequency representation of the time domain data, wherein generating the time-frequency noise reduction mask for a particular time-frequency bin comprises:

determining an initial value of the mask as a function of a ratio of (i) an estimated power spectral density of the noise corresponding to the particular time-frequency bin, and (ii) an estimated power spectral density of a measured signal corresponding to the particular time-frequency bin, and updating the initial value of the mask to generate an updated value of the mask, wherein the updating comprises:

determining a time-smoothing parameter for updating the initial value as a function of initial or updated values of one or more additional masks corresponding to time-frequency bins along the time axis of the 2D time-frequency representation, wherein the time-smoothing parameter is a function of the initial or updated values of multiple masks corresponding to different time points, and generating the updated value of the mask as a function of the time-smoothing parameter, and generating a time domain output based on the noise-reduced time-frequency representation.

2. The method of claim 1, wherein updating the initial value of the mask further comprises:

determining a frequency-smoothing parameter for updating the initial value as a function of the initial or updated values of one or more additional masks corresponding to time-frequency bins along the frequency axis of the 2D time-frequency representation, wherein the frequency smoothing parameter represents a variable number of time-frequency bins along the frequency axis that are used in updating the initial value; and generating the updated value of the mask as a function of the frequency-smoothing parameter.

3. The method of claim 2, further comprising:

receiving input on an upper limit of a frequency range for frequency smoothing; and determining the number of time-frequency bins along the frequency axis that are used in updating the initial value as a function of the upper limit of a frequency range.

4. The method of claim 1, wherein the updated value of the mask is generated as a function of a frequency-smoothing parameter in addition to the time-smoothing parameter, and wherein updating the initial value of the mask further comprises:

determining the frequency-smoothing parameter as a function of the initial or updated values of one or more additional masks corresponding to time-frequency bins along the frequency axis of the 2D time-frequency representation.

5. The method of claim 4, wherein:

the time smoothing parameter is a function of the initial or updated values of multiple masks corresponding to different time points, and the frequency smoothing parameter represents a variable number of time-frequency bins along the frequency axis that are used in updating the initial value.

6. The method of claim 5, further comprising:

receiving input on an upper limit of a frequency range for frequency smoothing; and determining the number of time-frequency bins along the frequency axis that are used in updating the initial value as a function of the upper limit of a frequency range.

7. A system comprising:

a noise analysis engine including one or more processing devices, the noise analysis engine configured to:

receive multiple samples of time-domain data that includes noise, compute a first two-dimensional (2D) time-frequency representation of the time domain data, and process the first time-frequency representation using a time-frequency noise reduction mask to generate a second, noise-reduced time-frequency representation of the time domain data, wherein generating the time-frequency noise reduction mask for a particular time-frequency bin comprises:

determining an initial value of the mask as a function of a ratio of (i) an estimated power spectral density of the noise corresponding to the particular time-frequency bin, and (ii) an estimated power spectral density of a measured signal corresponding to the particular time-frequency bin, and updating the initial value of the mask to generate an updated value of the mask, wherein the updating comprises:

determining a time-smoothing parameter for updating the initial value as a function of initial or updated values of one or more additional masks corresponding to time-frequency bins along the time axis of the 2D time-frequency representation, wherein the time-smoothing parameter is a function of the initial or updated values of multiple masks corresponding to different time points, and generating the updated value of the mask as a function of the time-smoothing parameter, and a reconstruction engine that generates a time domain output based on the noise-reduced time-frequency representation.

8. The system of claim 7, wherein updating the initial value of the mask further comprises:

determining a frequency-smoothing parameter for updating the initial value as a function of the initial or updated values of one or more additional masks corresponding to time-frequency bins along the frequency axis of the 2D time-frequency representation, wherein the frequency smoothing parameter represents a variable number of time-frequency bins along the frequency axis that are used in updating the initial value; and generating the updated value of the mask as a function of the frequency-smoothing parameter.

9. The system of claim 8, wherein the noise analysis engine is configured to:

receive input on an upper limit of a frequency range for frequency smoothing; and determine the number of time-frequency bins along the frequency axis that are used in updating the initial value as a function of the upper limit of a frequency range.

10. The system of claim 7, wherein the updated value of the mask is generated as a function of a frequency-smoothing parameter in addition to the time-smoothing parameter, and wherein updating the initial value of the mask comprises:

determining the frequency-smoothing parameter as a function of the initial or updated values of one or more additional masks corresponding to time-frequency bins along the frequency axis of the 2D time-frequency representation.

11. The system of claim 10, wherein:

the time smoothing parameter is a function of the initial or updated values of multiple masks corresponding to different time points, and the frequency smoothing parameter represents a variable number of time-frequency bins along the frequency axis that are used in updating the initial value.

12. The system of claim 11, wherein the noise analysis engine is configured to:

receive input on an upper limit of a frequency range for frequency smoothing; and determine the number of time-frequency bins along the frequency axis that are used in updating the initial value as a function of the upper limit of a frequency range.

13. One or more non-transitory machine-readable storage devices storing machine-readable instructions that cause one or more processing devices to execute operations comprising:

receiving multiple samples of time-domain data that includes noise;

computing a first two-dimensional (2D) time-frequency representation of the time domain data;

processing the first time-frequency representation using a time-frequency noise reduction mask to generate a second, noise-reduced time-frequency representation of the time domain data, wherein generating the time-frequency noise reduction mask for a particular time-frequency bin comprises:

determining an initial value of the mask as a function of a ratio of (i) an estimated power spectral density of the noise corresponding to the particular time-frequency bin, and (ii) an estimated power spectral density of a measured signal corresponding to the particular time-frequency bin, and updating the initial value of the mask to generate an updated value of the mask, wherein the updating comprises:

determining a time-smoothing parameter for updating the initial value as a function of initial or updated values of one or more additional masks corresponding to time-frequency bins along the time axis of the 2D time-frequency representation, wherein the time-smoothing parameter is a function of the initial or updated values of multiple masks corresponding to different time points, and generating the updated value of the mask as a function of the time-smoothing parameter, and generating a time domain output based on the noise-reduced time-frequency representation.

14. The one or more non-transitory machine-readable storage devices of claim 13, wherein updating the initial value of the mask further comprises:

determining a frequency-smoothing parameter for updating the initial value as a function of the initial or updated values of one or more additional masks corresponding to time-frequency bins along the frequency axis of the 2D time-frequency representation, wherein the frequency smoothing parameter represents a variable number of time-frequency bins along the frequency axis that are used in updating the initial value; and generating the updated value of the mask as a function of the frequency-smoothing parameter.

15. The one or more non-transitory machine-readable storage devices of claim 14, the operations further comprising:

receiving input on an upper limit of a frequency range for frequency smoothing; and determining the number of time-frequency bins along the frequency axis that are used in updating the initial value as a function of the upper limit of a frequency range.

16. The one or more non-transitory machine-readable storage devices of claim 13, wherein the updated value of the mask is generated as a function of a frequency-smoothing parameter in addition to the time-smoothing parameter, and wherein updating the initial value of the mask comprises:

determining the frequency-smoothing parameter as a function of the initial or updated values of one or more additional masks corresponding to time-frequency bins along the frequency axis of the 2D time-frequency representation.

17. The one or more non-transitory machine-readable storage devices of claim 16, wherein:

the time smoothing parameter is a function of the initial or updated values of multiple masks corresponding to different time points, and the frequency smoothing parameter represents a variable number of time-frequency bins along the frequency axis that are used in updating the initial value.

* * * * *